US005790034A

United States Patent [19]

Khoury

[11] Patent Number: 5,790,034

[45] Date of Patent: Aug. 4, 1998

[54] RETROFITTABLE REMOTE CONTROLLED DOOR LOCK SYSTEM

[75] Inventor: Steve Khoury, Las Vegas, Nev.

[73] Assignee: Cyberlock L.L.C., Las Vegas, Nev.

[21] Appl. No.: 847,227

[22] Filed: May 1, 1997

[51] Int. Cl.[6] ..... G08B 15/00; E05B 47/02

[52] U.S. Cl. ..... 340/574; 70/256; 70/277; 70/279; 70/280; 292/144; 340/539; 340/825.31

[58] Field of Search ..... 340/574, 539, 340/825.31; 70/277, 279, 280, 256; 292/144

[56] References Cited

U.S. PATENT DOCUMENTS

| | | | |
|---|---|---|---|
| 4,074,269 | 2/1978 | Hartley | 340/539 |
| 4,802,353 | 2/1989 | Corder et al. | 70/277 |
| 4,854,143 | 8/1989 | Corder et al. | 70/218 |
| 4,946,207 | 8/1990 | Gillham | 292/173 |
| 4,984,441 | 1/1991 | Mauer | 70/27 |
| 5,083,448 | 1/1992 | Karkkainen et al. | 70/277 |
| 5,263,347 | 11/1993 | Allbaugh et al. | 70/257 |
| 5,386,713 | 2/1995 | Wilson | 70/280 |
| 5,404,737 | 4/1995 | Hotzl | 70/279 |
| 5,437,174 | 8/1995 | Aydin | 70/278 |
| 5,499,014 | 3/1996 | Greenwaldt | 340/539 |
| 5,531,086 | 7/1996 | Bryant | 70/279 |
| 5,712,626 | 1/1998 | Andreou et al. | 340/825.31 |

*Primary Examiner*—Glen Swann
*Attorney, Agent, or Firm*—Larson & Taylor

[57] ABSTRACT

A retrofittable remote controlled deadbolt operating system is provided for locking and unlocking a deadbolt lock. The system has a transmitter that activates a receiver located on the actuator of the lock to engage a motor which is connected to gears that are in turn connected to an adaptor that mates with the actuator. The adaptor transfers the force of the motor in the necessary direction for operating the lock. The system also has a panic alarm siren that can be activated by the remote control. The remote controller can also be used to operate an existing garage door opener, and to turn on lights.

19 Claims, 3 Drawing Sheets

RETROFITTABLE REMOTE CONTROLLED DOOR LOCK SYSTEM

FIELD OF THE INVENTION

The present invention relates to door locks, and in particular, to a door lock system utilizing a wireless remote controlled deadbolt door lock and panic alarm system.

BACKGROUND OF THE INVENTION

Home safety has always been a concern, and accordingly, many of today's homes come equipped with doors that utilize both a door knob lock and an additional deadbolt lock. Many other doors have a single lock that is of the deadbolt type. Deadbolt locks are generally safer than normal door knob locks since the deadbolt is positioned deeper within the door frame than the corresponding bolt of normal door knob locks to better inhibit the door from being forced open. However, having to take the time upon entry to open any lock, or worse yet, both a door knob lock and a deadbolt lock, is at least an inconvenience, but at worst it increases the time one remains vulnerable.

Many remote controllable door locks are available. However, the need exists for providing a safety system that is retrofittable to existing deadbolt locks, while providing other safety features that are all actuated from a hand-held remote controller.

SUMMARY

In accordance with the present invention, a wireless remote controlled deadbolt operating system is provided which is adapted to retrofit on an existing deadbolt lock so that the lock can be automatically opened in an expedient manner at the appropriate time as one approaches the door. Conventional deadbolt locks typically have a deadbolt, a deadbolt receiver, and an actuator located on an interior side of the closure.

In accordance with the present invention, the lock system comprises a module which fits over a conventional existing deadbolt and has a drive means which is physically engaged with a portion of the existing deadbolt so as to operate same, to unlock the deadbolt, upon a signal received from a wireless remote transmitter.

In accordance with a first preferred embodiment of the invention, a lock system is provided for opening a conventional deadbolt lock of a securing closure. The system has a wireless remote transmitter for selectively transmitting electromagnetic signals to a receiver. The receiver is able to respond to the signals and then activate a drive means that is mounted on the interior side of the closure and attached to the actuator of the deadbolt lock. Furthermore, in a preferred implementation, a panic alarm may be incorporated into the system, and engageable by the receiver upon receipt of a signal from the transmitter.

In a second preferred embodiment, a lock system is provided for opening a conventional deadbolt lock wherein the system utilizes a remote transmitter, a door module unit for operating the deadbolt lock, and a separate wall module unit for operating safety components such as the panic alarm or lights. The door module of the second embodiment is very similar to that of the first embodiment. The wall module has a receiver of its own that is responsive to a signal received from the transmitter. In this embodiment, the wall module includes a panic alarm that is powered by direct current. The direct current is transformed from an alternating current that is input into to the wall module. The alternating current is also connected to a relay that is selectively activated by the receiver of the wall module to operate lights surrounding the lock. Advantageously, the transmitter of the second embodiment can be used to operate a conventional garage door opener in combination with the door lock system.

It is therefore an object of the present invention to provide a lock system that fits over and operates a conventional existing deadbolt upon receiving a signal from a wireless remote transmitter.

It is another object of the invention to provide a lock system that includes a panic alarm that can be activated by the same wireless remote transmitter that operates the lock system.

It is yet another object of the present invention to provide a lock system that has a door module that operates an existing deadbolt lock and a wall module that operates additional safety features, both modules being activated upon receipt of a signal from a wireless remote transmitter.

These and other objects, features and advantages of the invention will be set forth in, or apparent from, the detailed description of the preferred embodiments of the invention which follows.

BRIEF DESCRIPTIONS OF THE DRAWINGS

DESCRIPTION OF THE PREFERRED EMBODIMENTS

Figure 1:
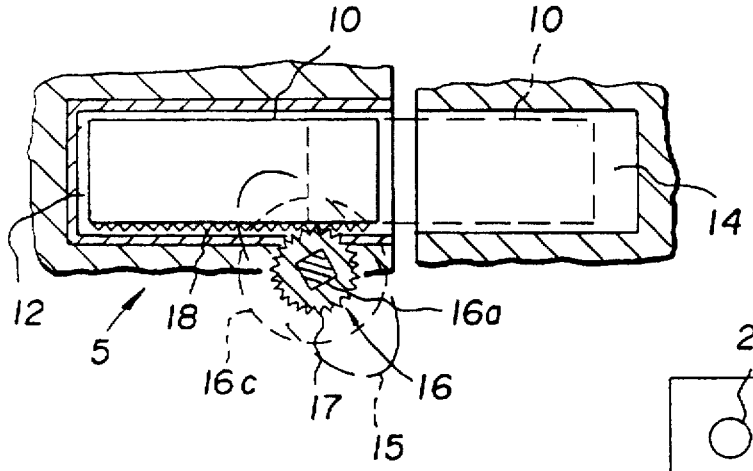
FIG. 1 is a partial cross-sectional elevation view of a conventional deadbolt lock.
Figure 5:
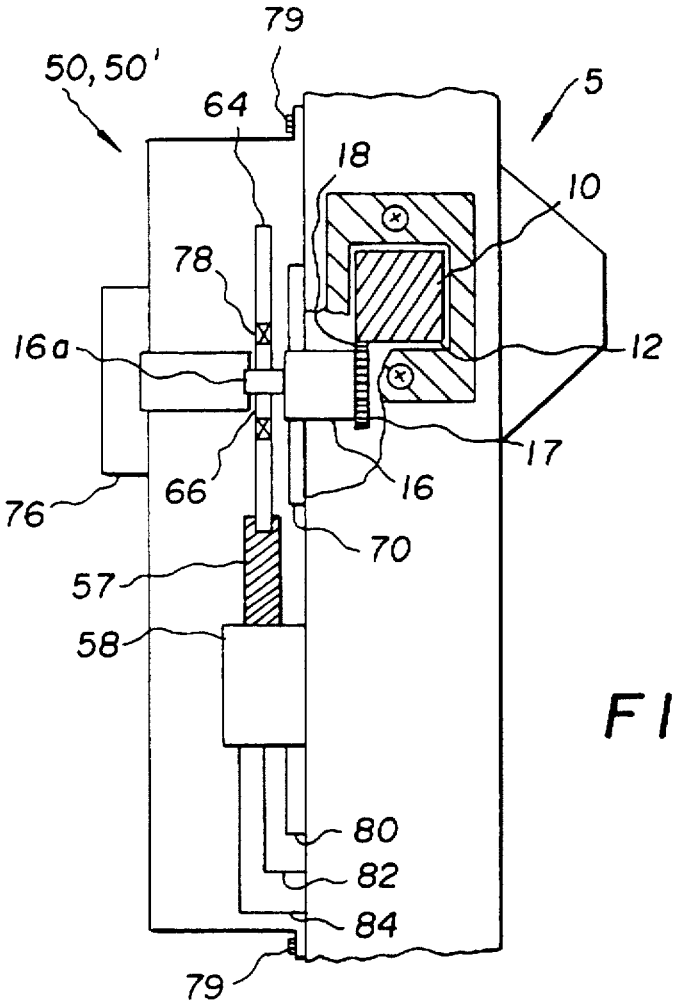
FIG. 5 is a side elevational view showing the deadbolt lock in partial cross-section and schematically illustrating portions of the door module.

Referring to FIG. 1 and also, in part to FIG. 5, there is illustrated a conventional deadbolt lock 5 comprising a deadbolt 10 and a deadbolt retainer channel 12 for retaining the deadbolt 10 in a retracted position when the deadbolt lock is unlocked. A deadbolt receiver channel 14 is longitudinally positioned opposite and adjacent to the retainer channel 12, for receiving the deadbolt 10 when the deadbolt lock 5 is in a locked position. Typically, the retainer channel 12 is located within a securing closure, such as a door, and the receiver channel 14 is located along the border of an opening, such as a door frame.

Deadbolt lock 10 is typically manually engageable and disengageable by an actuator 16 (whose handle 15 is shown in dashed lines). In this type of configuration, connected to the center of actuator 16 is a shaft **16*a* which cooperates with handles 15 so that together they provide a means for rotating actuator 16. Shaft 16*a* is shown as having a square-shaped end view, but some commonly known locks have different shapes for shaft 16*a*. For example, deadbolt locks made by Schlage have a shape that is almost square, except one of the sides of the would-be square shaft is slightly rounded. Alternatively, deadbolt locks made by Quickset utilize a thin rectangular shaft for the end view of shaft 16*a***.

Actuator 16 has gear teeth 17 which cooperate with corresponding gear teeth 18 on deadbolt 10, so that rotation of handle 15 extends and retracts deadbolt 10 into and out of channel 14. Gear teeth 17 are disposed only in that region near the corresponding gear teeth 18 so that a plate 16c (shown in dashed lines), having a hole in the center, can surround the actuator 16 to keep actuator 16 and lock 5 properly positioned, e.g. by screws or the like, once plate 16c is affixed to the door. Of course many types of actuators exist, such as those having a longitudinally sliding mechanism, and the present invention is adaptable to any type of actuator by cooperating with the actuator 16 and providing the requisite force in the direction needed for operating the deadbolt lock 5.

Figure 2:
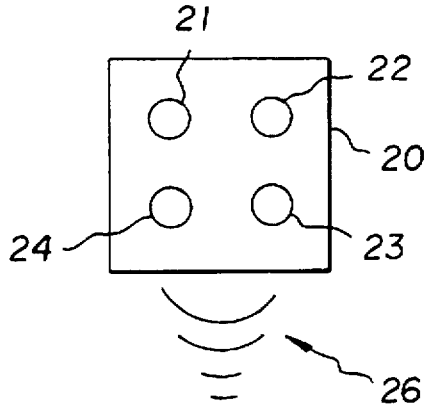
FIG. 2 illustrates schematically a transmitter used in accordance with the system of the present invention.

Referring to FIG. 2, there is shown a four channel hand-held wireless remote controller transmitter 20 for activating the various components of the system of the invention as discussed below. This transmitter 20 is conventional and can usually be purchased at any hobby or consumer electronics stores such as Radio Shack. Each of the four buttons 21, 22, 23 and 24 of transmitter 20 can send an electromagnetic (em) signal 26, in the form of waves of em radiation such as radio frequency, to the surrounding vicinity. Each of the buttons 21, 22, 23 and 24 can be programmed to activate any function of the system individually, or a combination of functions. Using a four channel transmitter and receiver by Visonic enables 68 billion rolling codes to be implemented for realizing a high degree of security to prevent unauthorized activation of the functions.

Figure 3:
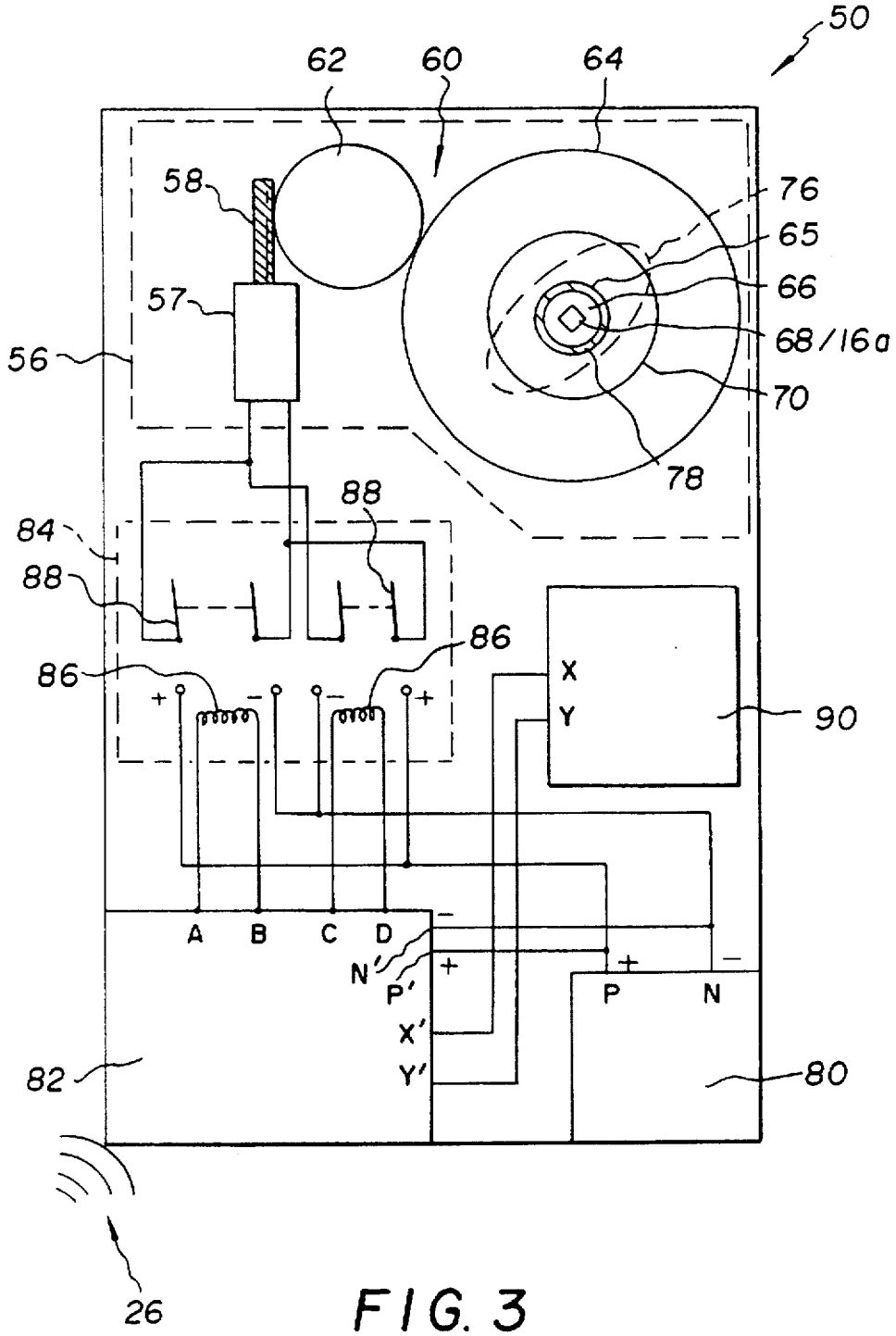
FIG. 3 is a schematic elevation view of the door module of a first embodiment of the present invention.

FIG. 3 is a schematic illustration of a door module component 50. Door module 50 is adapted to interface or cooperate with existing deadbolt lock 5. Door module 50 securely mounts about deadbolt lock 5 so as to be able to effect the necessary deadbolt operating motions. In order to mount door module 50 onto the existing deadbolt lock 5, handle 15 and plate 16c are removed, thus exposing square shaft 16a.

Door module 50 has a retrofittable drive module 56 that comprises drive means in the form of a motor 57 which has a bi-directional screw-type output shaft 58 which cooperates with a gear means 60. Of course, any drive means is suitable as long as the drive means is able to provide the necessary force and motion for operating deadbolt lock 5. Gear means 60 is shown in FIG. 3 as including a small gear 62 that translates rotational force from motor output shaft 58 to a large gear 64. The gear ratios must be sufficient, based on the driving force of motor 57, to overcome the usual frictional forces involved with operating standard deadbolt locks.

A means for securing the drive module 56 to the existing actuator 16 is also illustrated in FIG. 3. FIG. 3 shows gear 64 as having a circular opening 65 for receiving a part 66 and a rubber O-ring 78. Part 66 has a square opening 68 in the center that allows the passage of square shaft 16a through a face (not shown) of door module 50. A replacement plate 70 is used to engage actuator 16 in the way that removed plate 16c previously engaged actuator 16, but replacement plate 70 is used instead so as to ensure a proper fit with door module 50. A replacement handle or knob 76, shown in dashed lines, can be placed on the end of shaft 16a that extends out of component 50 to provide a means for continued manual operation of deadbolt lock 5 without transmitter 20.

It will be appreciated that in order to move shaft 16 manually with replacement handle 76, O-ring 78, located around part 66 and interfacing with gear 64, allows slippage between the part 66 and gear 64 so that one need simply operate replacement handle 76 in the same fashion that handle 15 was operated prior to the retrofitting of the system without encountering resistance from door module 50. However sufficient friction exists between part 66, O-ring 78 and gear 64 such that when door module 50 is activated, the deadbolt lock 5 is operated.

Once door module 50 is properly positioned to fit over existing deadbolt lock 5, door module 50 is affixed to deadbolt lock 5, and/or the door which deadbolt lock 5 is intended to lock, by any conventional means such as mechanical fasteners, screws, adhesive, etc. Door module 50 must be secured so that drive module 56 can move actuator 16 in the desired direction to operate lock 5.

In order to enable door module 50 to operate deadbolt lock 5, drive motor 57 must receive power from a power 80. Power source 80 can be any suitable power source that supplies the type of power required by the components of the system. For example, the illustrated bi-directional motor 57 uses a direct current (DC) battery. However, an alternating current (AC) source, or even an AC source converted to DC by a transformer might be suitable for other components. In the embodiment shown in FIG. 3, power source 80 is a 12 volt DC battery comprised of two 6 volt camera "T" type batteries connected in series that have a positive contact P and a negative contact N and are connected to a receiver 82 at contacts P' and N', respectively.

In order to activate the system, receiver 82 must be capable of receiving at least one of the plurality of signals 26 generated by transmitter 20 to then activate a particular function of the system. Receiver 82 is shown as being connected to power source 80 so that receiver 82 can generate an output signal upon receiving a transmitted signal from transmitter 20. Each output signal generated by the receiver 82 activates a particular function of the system.

For example, when one of the buttons 21, 22, 23 or 24 of transmitter 20 is pushed for operating the deadbolt lock 5, the receiver 82 generates an output signal to operate connecting means 84 so that drive motor 57 is connected to power source 80 and the deadbolt lock 5 is actually engaged or disengaged. Typically, remote controlled systems are set so that consecutive button pushing toggles between two functions, such as a lock function and an unlock function. In this case, the connecting means 84 provides this alternating action by supplying DC in the opposite direction to motor 57.

Connecting means 84 is shown in FIG. 3 as comprising a double pole, double throw (DPDT) relay. This type of relay is conventional and can be purchased at most consumer electronics stores. The relay of connecting means 84 is shown as having a pair of primary coils 86 that are each supplied with current from the output signal of the receiver 82 along lines connected to contacts A and B, and C and D, respectively. Current through a primary coil induces a magnetic field that attracts the corresponding switch 88 to close the circuit and connect drive motor 57 with power source 80. Of course, any connecting means that closes the electrical circuit to supply the requisite power is suitable.

Additionally, a panic alarm 90 can be operatively connected, at contacts X and Y, to receiver 82 at contacts X' and Y', and activated by other signals from the transmitter 20, or simultaneously activated by the same signal that operates the deadbolt lock 5.

Figure 4:
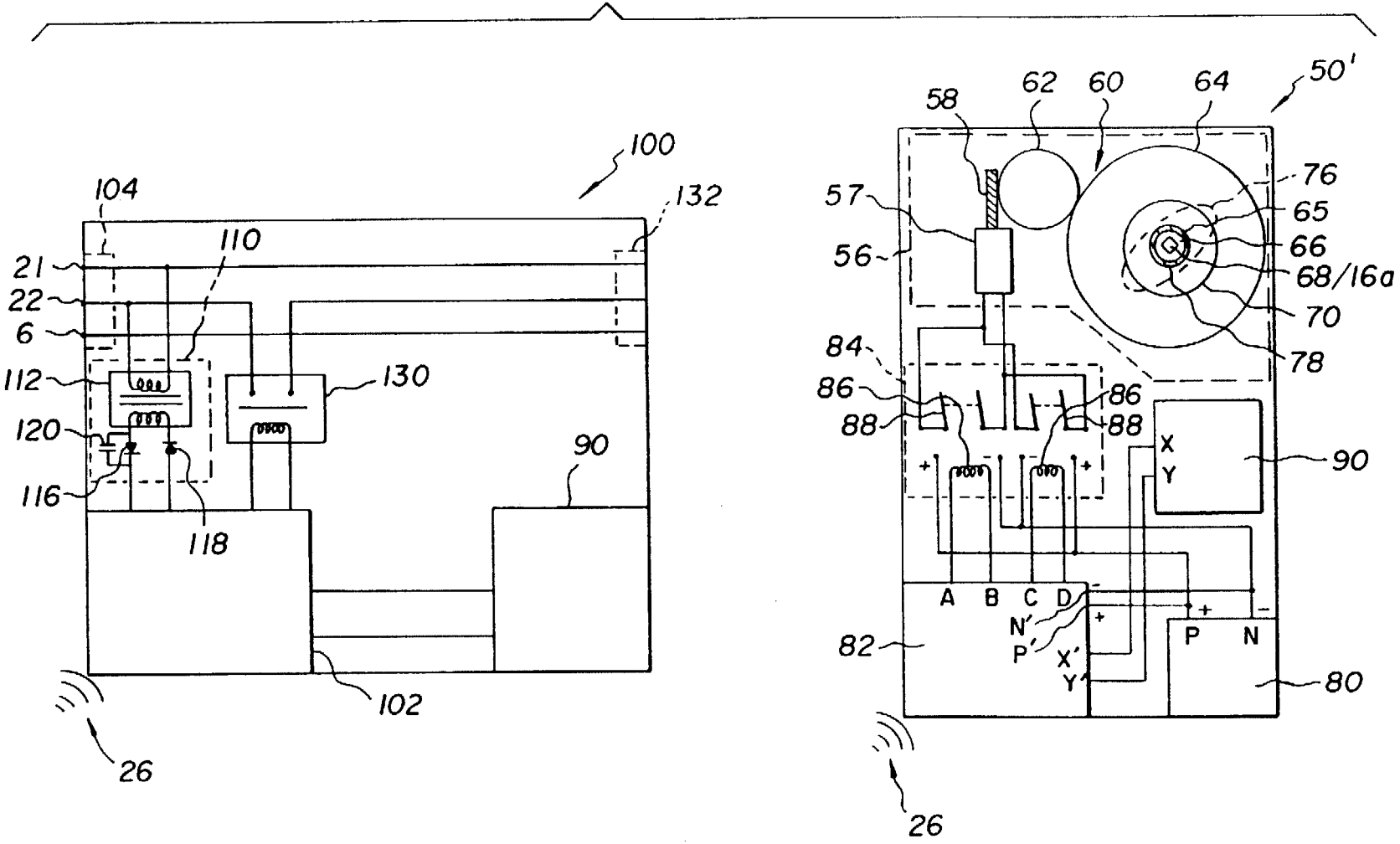
FIG. 4 is a schematic elevation view of a second embodiment of the present invention having both a door module and a wall module.

FIG. 4 illustrates a schematic view of a second embodiment of the present invention comprising a wall module 100 and a door module 50'. Door module 50' is very similar to door module 50 except that instead of the panic alarm 90 being located in the door module so as in the first embodiment, panic alarm 90 is now a part of wall module 100.

Also located within wall module 100 is a receiver 102 that receives signals from transmitter 20 in the same fashion as receiving means 82. Panic alarm 90 is connected to receiver 102. Upon receipt of an appropriate signal from transmitter 20, panic alarm 90 is activated. Panic alarm 90 can be a 200 decibel 12 volt "warble" siren which produces a loud noise for attracting attention of passers-by when the user of the system is in a panic situation.

Wall module 100 is supplied with power by an input power source 104 that can be any suitable power source. Input power source 104 shown in FIG. 4 is a wall socket plug that connects to alternating current (AC) source supplied by a typical AC socket, having two input lines L1 and L2 and a grounded line G, that is found in most homes.

Input power source 104 is connected to convertor 110 that converts AC into DC. This conversion occurs by passing AC into a transformer 112 that is connected to output current and to a pair of diodes 116 and 118 that are in turn connected to the receiver 102. The diodes 116, 118 are oppositely oriented and diode 116 is connected in parallel to a capacitor 120 that helps provide a more stable wave form of current from converter 110 to receiver 102.

Receiver 102 is also connected to a relay 130. Relay 130 is connected to an output 132 that supplies AC upon receiving an appropriate signal from transmitter 20. AC power can thus be supplied to at least one safety component such as lights for illuminating the interior of the home having deadbolt lock 5 or exterior lights that illuminate the area surrounding lock 5.

With the four channel transmitter 20, one signal activation button can be used to transmit a signal type that is used to activate a remote-controlled garage door opener which could be of any conventional type. Thus, transmitter 20 can be used in combination with the inventive system to activate both the door opener and the garage door opener.

FIG. 5 illustrates a side view of door module 50 or 50' to more clearly show how door module 50 or 50' is affixed to a door having a deadbolt lock 5. By simply replacing the original manual actuator with door module 50 or 50' that has a replacement actuator 76, one can readily adapt existing deadbolt locks to a remote control lock system. The whole new module 50 or 50' is simply attached to the door over the deadbolt lock and secured in place by suitable means such as screws 79, and an adhesive.

FIG. 5 assists in understanding the cooperation between shaft 16*a*, part 66, O-ring 78, and gear 64. Shaft 16*a* is securely engaged with part 66, and O-ring 78 supplies sufficient friction to transmit the operating motion from gear 64 to part 66, and thus shaft 16*a*. However, O-ring 78 allows for slippage so that if handle 76 is rotated, shaft 16*a* is rotated, but gear 64 remains stationary due largely to the stronger frictional forces internal to the cooperation between gear means 60 and motor 57.

Although the present invention has been described with respect to specific exemplary embodiments thereof, it will be understood by those skilled in the art that variations and modifications can be effected in these exemplary embodiments without departing from the scope and spirit of the invention.

What is claimed is:

1. A lock and panic alarm system for opening a conventional deadbolt lock of a securing closure, said lock comprising a deadbolt, a deadbolt receiver, and an actuator located on an interior side of the closure, comprising:

a wireless remote transmitter means for selectively transmitting a first and a second electromagnetic signal;

a receiver means for receiving and responding to the first and second signals transmitted by said transmitter means;

a drive means mounted on the interior side of the closure and attached to the actuator of the deadbolt lock for operating the actuator, said drive means being activated by said receiver means upon reception by said receiver means of the first signal from said transmitter means; and an alarm means for issuing a panic alarm when activated by said receiver means upon reception by said receiver means of the second signal from said transmitter means.

2. A lock system for opening a conventional deadbolt lock comprising a deadbolt, a deadbolt receiver, and an actuator, comprising:

a wireless remote transmitter means for selectively transmitting an electromagnetic signal;

a receiver means for receiving and responding to the signal transmitted by said transmitter means;

a drive means for operating the actuator, said drive means being activated by said receiver means upon reception by said receiver means of the signal from said transmitter means, said drive means including a means for operatively engaging an existing configuration of said actuator in order to connect said drive means thereto; and a means for securing said drive means to said deadbolt lock such that when said drive means is activated, said actuator is moved in an intended direction.

3. A system as in claim 2 wherein said engaging means further comprises a part that interfaces with said actuator, and an O-ring that surrounds said part and cooperates with said drive means such that friction between said drive means and said O-ring is sufficient to transmit a driving force, produced during operation of said system, to said part and in turn to said actuator to operate said deadbolt lock.

4. A system as in claim 3 wherein said actuator further comprises a shaft, and said part engagingly fits over said shaft.

5. A system as in claim 4 further comprising a knob that cooperatively engages said shaft such that when said knob is manually rotated said deadbolt lock is operated while said drive means remains stationary due to slippage occurring either between said O-ring and said part, or between said O-ring and said drive means.

6. A system as in claim 2 wherein said securing means comprises an adhesive and screws.

7. A system as claimed in claim 6 wherein said drive means further comprises a bi-directional screw-type motor, and a gear means for engaging said motor and for operating said deadbolt lock.

8. A system as claimed in claim 2 wherein said transmitter means is capable of transmitting a second electromagnetic signal, said receiver means is capable of receiving and responding to said second signal, and said system further comprises an alarm means for issuing a panic alarm when activated by said receiver means upon reception by said receiver means of the second signal from said transmitter means.

9. A system as claimed in claim 8 in combination with means for opening a garage door wherein said transmitter means is capable of transmitting a third signal, and wherein said garage door opening means further comprises an activation means for activating an existing garage door opening means that is operated by the third signal transmitted by said transmitter means.

10. A system as claimed in claim 2 wherein said transmitter means is capable of transmitting a second signal, said receiver means is capable of receiving and responding to said second signal, and wherein said system further comprises a light activation means for activating a light when said receiver means receives the second signal transmitted by said transmitter means.

11. A lock and panic alarm system for opening a conventional deadbolt lock comprising a deadbolt, a deadbolt receiver, and an actuator, comprising:

(a) a wireless remote transmitter means for selectively transmitting a plurality of electromagnetic signals;

(b) a wall module comprising, a first receiver means for receiving first and second signals of said plurality of signals from said transmitter means, alternating current input means for receiving alternating current from a conventional wall socket alternating current source, a transformer means for transforming alternating current supplied from said input means into direct current and for supplying said direct current to said first receiver means, an output means for outputting said alternating current supplied from said input means upon connection of said output means to said input means, a first connecting means for connecting said output means to said input means in order to output AC from said output means, wherein said first connecting means is activated by said first receiver means upon reception by said first receiver means of the first signal of said plurality of signals from said transmitter means, and an alarm means for issuing a panic alarm, wherein said alarm means is activated by said first receiver means upon reception by said first receiver means of the second signal of said plurality of signals from said transmitter means; and (c) a door module means, adapted to be fit onto said conventional deadbolt lock for opening said deadbolt lock, said door module means comprising, a second receiver means for receiving a third signal of said plurality of signals from said transmitter means, a power means for supplying power to said second receiver means, a drive means for operating said deadbolt lock when power is supplied to said drive means, and a second connecting means for connecting said drive means to said power means to operate said deadbolt lock, wherein said second connecting means is activated by said second receiver means upon reception by said second receiver means of the third signal of said plurality of signals from said transmitter means.

12. A system as claimed in claim 11 wherein said drive means further comprises a bi-directional screw-type motor, and a gear means for engaging said motor and for operating said deadbolt lock.

13. A system as claimed in claim 11 wherein said second connecting means further comprises a first relay switch that connects said drive means to said power means so as to open said deadbolt lock, and a second relay switch that connects said drive means to said power means so as to close said deadbolt lock, wherein said first and said second relay switches are alternately activated upon consecutive reception by said second receiving means of the third signal from said transmitter means.

14. A system as claimed in claim 11 further comprising a light connected to said output means and wherein reception by said first receiver means of said first signal-type supplies alternating current to said light.

15. A system as claimed in claim 11 further comprising a garage door opening means and wherein said transmitter means generates a fourth signal for activating said garage door opening means.

16. A system as claimed in claim 11 wherein said first connecting means comprises a relay switch.

17. A system as claimed in claim 11 wherein said alarm means comprises a siren.

18. A system as claimed in claim 11 wherein said power means comprises a twelve-volt battery.

19. A system as claimed in claim 18 wherein said power means comprises two six-volt camera T-type batteries connected in series.

* * * * *